US005305562A

United States Patent [19]

Sapia

[11] Patent Number: 5,305,562

[45] Date of Patent: Apr. 26, 1994

[54] RAIN GUTTER COVER

[76] Inventor: John A. Sapia, 69 Locust Point Rd., Locust, N.J. 07760

[21] Appl. No.: 935,978

[22] Filed: Aug. 27, 1992

[51] Int. Cl.[5] ..... E04D 13/00

[52] U.S. Cl. ..... 52/12; 52/11

[58] Field of Search ..... 52/12, 11

[56] References Cited

U.S. PATENT DOCUMENTS

| | | | |
|---|---|---|---|
| 4,411,110 | 10/1983 | Carey | 51/11 |
| 4,447,994 | 5/1984 | Garneau | 52/11 |
| 4,467,570 | 8/1984 | Kriegel | 52/12 |
| 4,616,450 | 10/1986 | Shouse | 52/12 |
| 4,667,448 | 5/1987 | Smith | 52/12 |
| 4,750,300 | 6/1988 | Winger | 52/12 |
| 4,765,101 | 8/1988 | Wolf | 52/12 |
| 4,888,920 | 12/1989 | Marulic | 52/12 |
| 4,965,969 | 10/1990 | Antenen | 52/12 |
| 5,099,620 | 3/1992 | Carey | 52/12 |

*Primary Examiner*—Carl D. Friedman

*Assistant Examiner*—Beth A. Aubrey

*Attorney, Agent, or Firm*—Charles I. Brodsky

[57] ABSTRACT

A cover for a hollow rain gutter, according to the invention, is described as having an upwardly pitched top surface arranged to seat beneath the shingles of a roof at which the gutter has previously been secured, a downwardly pitched front surface extending towards the trough of the gutter, and a single row of interrupted slots running horizontally along the front surface of the cover, with the lower edges of the slots extending below the front lip of the gutter, and with the top-edges of the slots aiding in defining a plurality of rearwardly and downwardly extending flaps for diverting rain received across the top surface into the trough of the gutter. The cover of the invention may be obtained in any length desired, and can be connected to the gutter by readily available "clips", thereby making its installation easy for even the average handyman or homeowner.

12 Claims, 4 Drawing Sheets

RAIN GUTTER COVER

FIELD OF THE INVENTION

This invention relates to rain gutters and, more particularly, to a cover for preventing undesired entry of leaves and other debris of a tendency to cause clogging and stoppage of rain flow through downspouts which are connected thereto.

BACKGROUND OF THE INVENTION

U.S. Pat. No. 4,411,110—Carey—describes a rain gutter construction said to offer particular advantage in preventing leaves, twigs, and other debris from entering the gutter and stopping rain flow into the connected downspouts. One limitation of such arrangement is the obviously clear showing of its restriction as a completed construction. That is, the gutter disclosed is only adapted for use where a new dwelling or building is to be constructed, or where a gutter is to be added to an existing dwelling or building, or where an existing gutter is to be removed and replaced with a new configuration. Clearly, there are millions-and-millions of dwellings and buildings where gutters already exist and where there is no intention of replacing them in the near future. It goes without saying that the teachings of this patent cannot there be put to use.

I have thought of modifying the disclosure of this patent, so as to construct a cover embodying its principles into an already existing gutter. However, this produced problems of its own—which, upon analysis and testing, were also found present in the design of U.S. Pat. No. 4,411,110 as a complete gutter construction. Thus, where it was the intention of this prior patent to employ narrow slots so as to keep leaves, rocks, twigs and nails from entering the gutter, such narrow slots themselves became clogged—especially when the installation was on a dwelling or building surrounded by pine trees or honey locust trees whose needles and sap tend to clog up the openings. In such situations, it has been found necessary to brush these slots clear periodically, sometimes up to three times per year.

Additional testing and analysis has also shown a further drawback in the prior teachings, as resulting from the relatively short length of the flaps established in the slots to guide and divert rainwater into the gutter. More specifically, such flaps must be critically angled even to operate as there described—but suffer the disadvantage that in colder weather, any rainwater guided along the flap by surface adhesion exhibited a tendency to freeze-up—where such "freeze-up" occurred, or where the flap was not angled properly, the guided rainwater did not completely fall into the trough, but fell by gravity, instead, along the facial board and sides of the structure.

Were this not bad enough, the situation grew worse when one tried to employ these features in fabricating a cover for an existing gutter. More particularly, in order to implement the teachings—and with a plurality of rows of interrupted slots to capture the rain—, in many installations it became necessary to lower the gutter so that the top surface of the cover could fit properly with the roof. Many of the average handymen who might try to install such an arrangement were found to lack the talent to lower these gutters properly—and such an undertaking was found to be completely beyond the ability and imagination of the average homeowner. In almost every instance, furthermore, investigation showed that the handyman or homeowner lacked the proper tools to begin such an undertaking, including the power screwdriver needed to secure the collar and rear walls of this earlier construction to the facial board (if intended to secure the construction by screws) and, most certainly, the tools needed to connect the cover to the existing gutter. As a result, it was found that any attempt to carry these patented teachings to a gutter installation that already had been erected required the skill of the professional installer, and at an increased cost.

OBJECTS OF THE INVENTION

It is an object of the present invention, therefore, to provide a cover for a hollow rain gutter that eliminates these limitations and restrictions of the prior art.

It is another object of the invention to provide such a cover which can be simply and easily installed by a handyman or homeowner and essentially without any tools other than a ladder to climb upon.

SUMMARY OF THE INVENTION

As will become clear from the description that follows, a cover for a hollow rain gutter, according to the invention, has an upwardly pitched top surface arranged to seat beneath the shingles of a roof at which the gutter has previously been secured, a downwardly pitched front surface extending towards the trough of the gutter and a single row of interrupted slots running horizontally along the front surface of the cover. While one might believe that a preferred arrangement might be one which incorporates the plurality of rows of interrupted slots as shown in U.S. Pat. No. 4,411,110, experimentation has shown that this required a lowering of the gutter already in place, in order to have the top surface seat beneath the shingles of the roof. In accordance with this invention, therefore, and as will be seen, only a single row of slots is employed.

In further accordance with the invention, the lower edges of these interrupted slots will be noted to extend below the front lip of the gutter, and with the top edges of the slots aiding in defining a plurality of rearwardly and downwardly extending flaps for diverting rain received across the top surface into the trough of the gutter. As will be appreciated by those skilled in the art, such placement of the lower-edges of the slots below the front lip of the gutter yields the advantage that any rainwater which flows along the front surface between the slots—i.e., along their tab separations, is constrained to fall directly into the gutter, without the need for there having to be a second or a third row of such slots (as in U.S. Pat. No. 4,411,110) to catch such flow for its guidance into the trough of the gutter.

As will additionally be seen from the description that follows, the present invention is described in the context of utilizing these horizontally extending slots of a dimension greater than that in this prior patent, so as to minimize the needs for periodically clearing—as by brushing—these openings free; as will be apparent, this follows from the realization that leaves and other debris can pass through the openings, provided they continue to be of a size as will flow through the downspout to which the gutter is connected. In such event, larger-size slots can be used, thereby obviating the situation where the slots are so narrow as to be easily clogged by tree sap or needles.

As will become clear to those skilled in the art, the end result will be seen to be a cover that once obtained of a desired length, can be readily and easily fastened to the gutter—, and, as will be described, can be secured with readily available "clips" which can be secured without the necessity of any tools.

BRIEF DESCRIPTION OF THE DRAWING

These and other features of the present invention will be more clearly understood from the consideration of the following description, taken in connection with the accompanying drawing, in which.

DETAILED DESCRIPTION OF THE DRAWING

Figure 1:
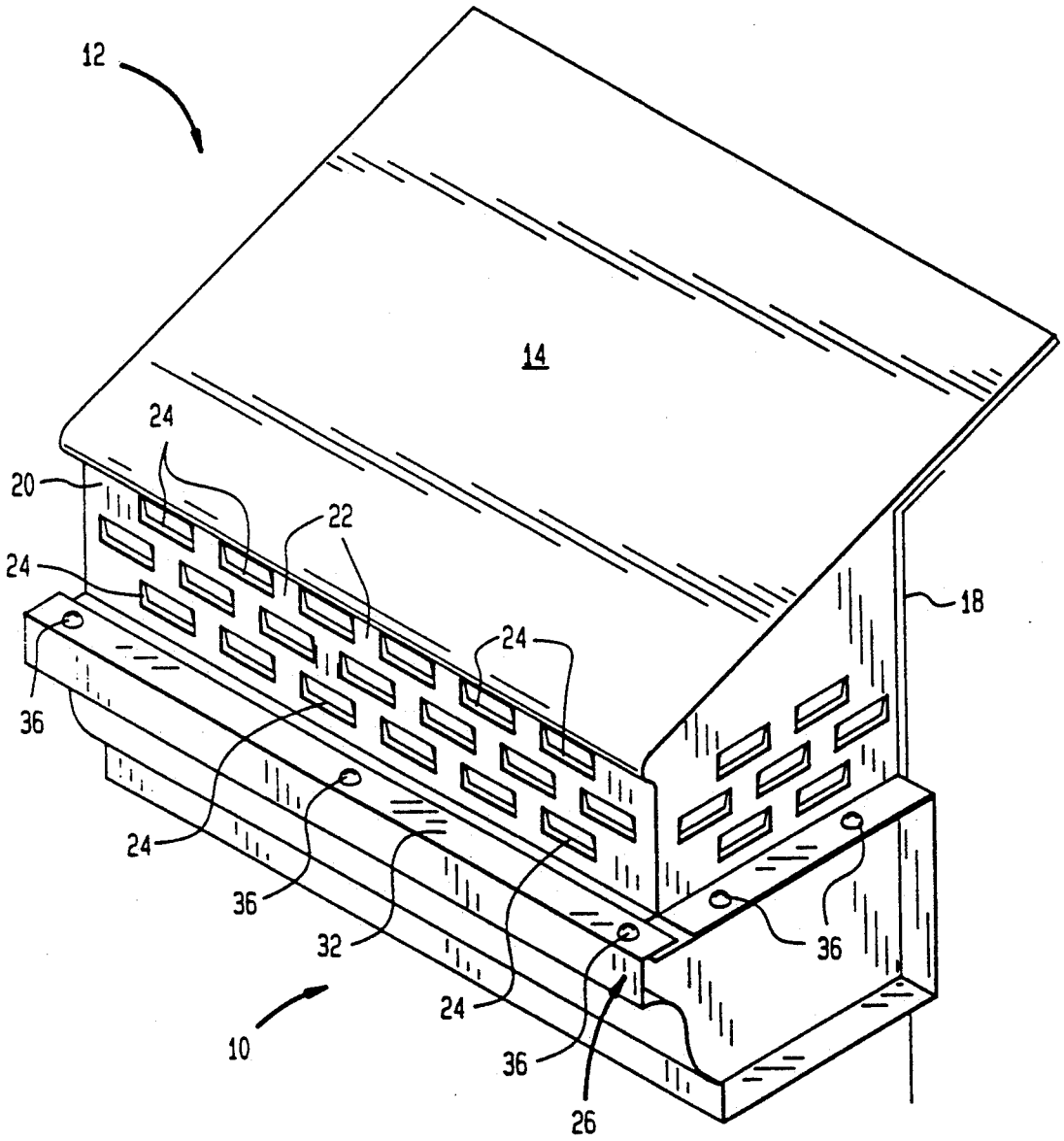
FIG. 1 (PRIOR ART)
FIG. 1 is a perspective view showing the attempted installation of a cover with an existing rain gutter following the teachings of U.S. Pat. No. 4,411,110.
Figure 2:
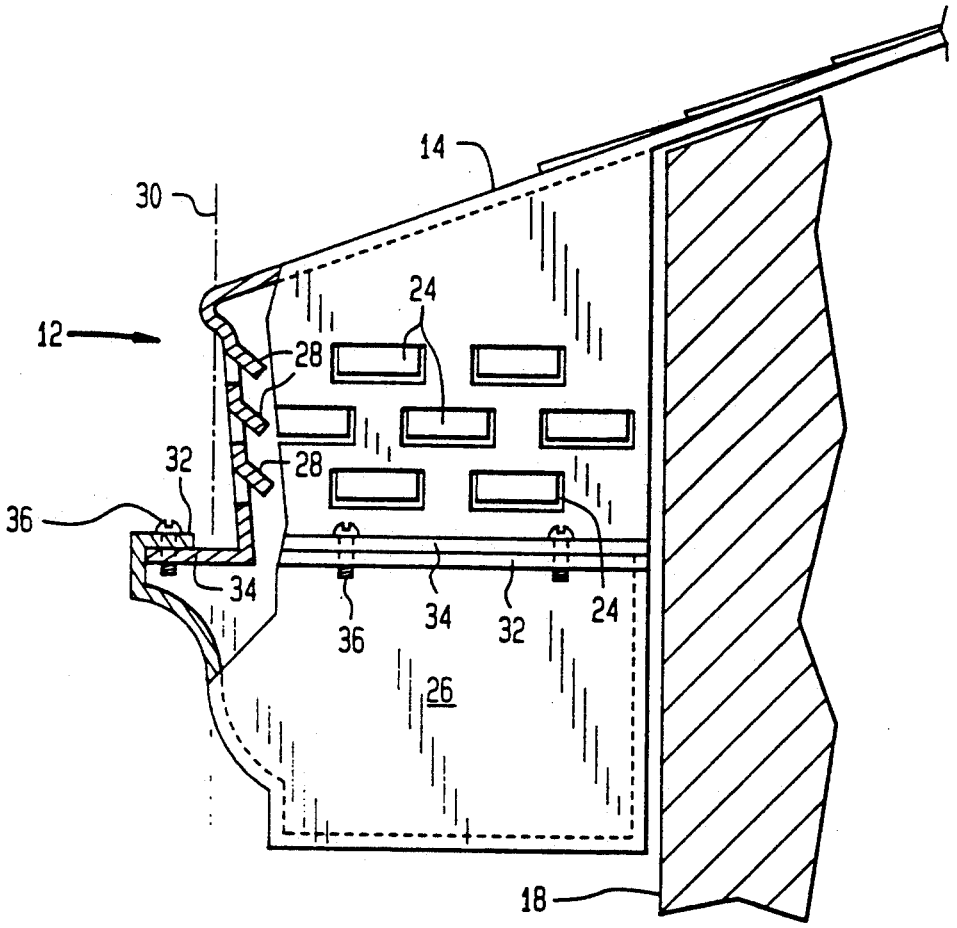
FIG. 2 (PRIOR ART)
FIG. 2 is a transverse, cross-sectional view taken along the line 100 in FIG. 1 to assist in an understanding of the present invention.

In the prior art drawings of FIGS. 1 and 2 reference numeral 10 identifies the existing rain gutter, while reference numeral 12 identifies a cover to be utilized therewith, and in accordance with the teachings of U.S. Pat. No. 4,411,110. As will be seen, the cover 12 includes an upwardly pitched top surface 14 arranged to seat under the shingles of a roof (not shown), or just to extend to reach the facial board 18 of a building that does not have a shingled-roof fabrication. The cover is shown as having a downwardly pitched front surface 20 including a plurality of longitudinally extending, generally horizontally disposed rows 22 of interrupted slots 24—which, in an actual construction, were found to be $1\frac{1}{8}''$ long by $\frac{1}{2}''$ wide.

As shown, and as described in the aforementioned patent, the interruptions between the individual slots 24 are displaced horizontally with respect to the interruptions between the slots of the next adjacent row, such that there is generally no vertical path of rain flow down the front surface 20 which is not interrupted by at least one of the slots. As will be apparent, because a plurality of rows of slots 22 are employed, the gutter 10 would have to be lowered to maintain the desired pitch of the top surface 14 with respect to the roof so as to insure that the pitch allows for the downward flow of rainwater from off the roof and into the trough 26 of the gutter 10—otherwise, the top surface pitch would be flattened were the gutter 10 to remain at its original location.

Also shown, and in accordance with the teachings of that patent, are a plurality of flaps 28 which are bent inwardly and downwardly towards the trough 26, to guide rainwater flow by surface adhesion inwardly of the gutter. As will be appreciated, such flaps 28 can be no longer than the width of the slot 24 from which they are stamped, and thus can extend inwardly only a limited amount —not greater than $\frac{1}{2}''$ with the prior art construction of such patent. As a result, even if the critical angulation of the front surface 20 is maintained with respect to the vertical—as illustrated by the line 30—, only a small contribution is made towards assuring that captured rain flow would travel along the flap 28, so as to fall by gravity into the trough 26. Also, any debris carried along one flap drops onto the one below it, causing the slots to clog from the bottom up.

What with the "plurality of rows" 22, their narrow widths, and with their limited flap-length, a professional installation of the cover 12 is required, the slots tend to clog needlessly, and the contribution of the flaps 28 is limited.

As will also be understood, following the teachings of U.S. Pat. No. 4,411,110, the lower edge of the bottom row of slots must sit above the lip of the gutter 32 so as to achieve the full results of the capture of the rainwater, with the result that substantially the only way that the gutter 10 can be secured to the lower most edge 34 of the front surface 20 is by a screwing-together of the lip 32 with the edge 34 as by the fastener 36; in other words, no readily available clip is known which can ride over the top of the lip 32, the lower edge of the slot 24 in the bottom row, and then around beneath the underside of the lower most edge 34. A professional installation of the gutter 10 and cover 12 is thus required.

Figure 3:
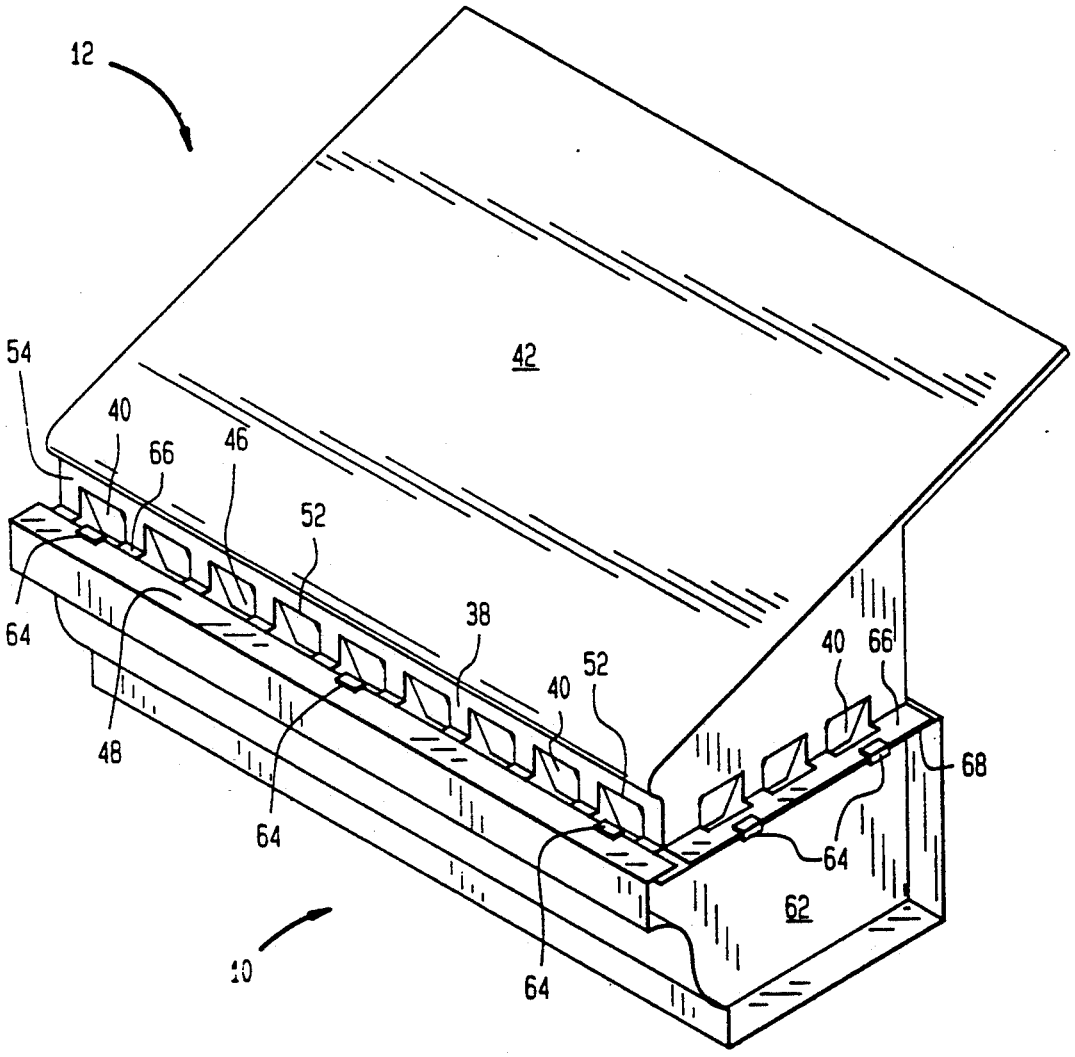
FIG. 3 is a perspective view of a cover for a rain gutter embodying the principles of the present invention.
Figure 4:
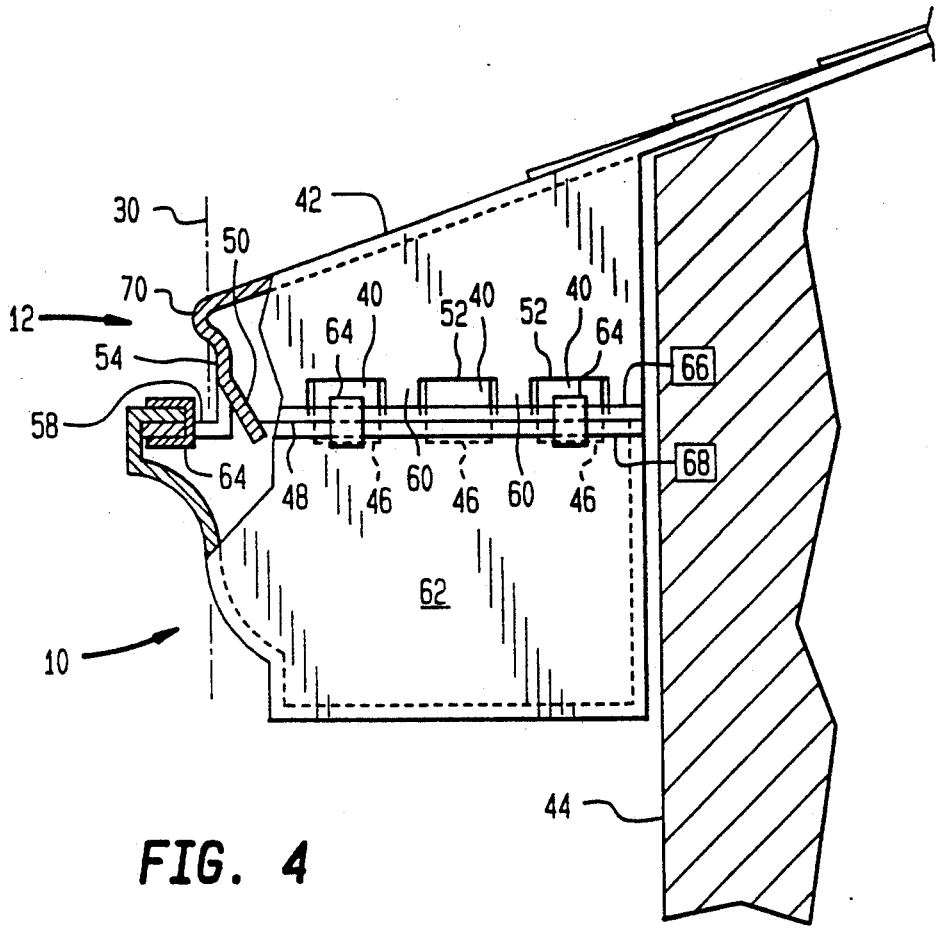
FIG. 4 is a transverse, cross-sectional view taken along the line 100 in FIG. 3.

In FIGS. 3 and 4, on the other hand, the front surface 20 of the cover 12 is shown as having only a single row 38 of slots 40, which will be seen to be of greater size than the slots 24—typically, according to the invention, some $1\frac{1}{4}''$ long and some $1\frac{1}{4}''$ wide. The top surface 42 continues to be upwardly pitched so as to seat below the shingles of the roof, or to extend to reach the facial board 44 in those structures that do not have shingled roofs. As will be seen, the lower edges 46 of the slots 40 extend below the lip 48 of the gutter 10 while a plurality of rearwardly and downwardly extending flaps 50 are provided along the top edges 52 of the slots 40. As will be seen, the front surface 54 is composed of a pair of upper and lower angularly disposed sections 56, 58, with the lower edges 46 of the slots 40 extending forwardly in the lower section 58 below the lip 48. The top edges 52 of the slots 40 will be seen to be in the upper section 56.

As will also be seen, the flaps 50 extend inwardly into the gutter a distance substantially greater than the distance by which the flaps 28 extend downwardly and inwardly into the gutter 10 of FIGS. 1 and 2. In accordance with one embodiment of the invention, such flaps were selected substantially 1" long and 1" wide. Experimentation has shown that any leaves, twigs or debris of a size to fit within the slot 40, as partially blocked by the flap 50 was still of a size as would not clog the downspout with which such gutter is used, and permit the flow of rainwater therethrough.

As will be apparent, by employing only a single row 38 of slots 40—and by having a resiliently flexible material selected for the top surface 42—, it becomes an easy task of bending the top surface 42 to seat below the roof shingles. By having only a single row of slots, testing has shown that there exists no need to lower the gutter 10, so as to retain the appropriate angle for the top surface 42 in having the rain flow continue from off the roof down to the front surface 54, by surface adhesion. By having larger slots 40, the rain flow continues to enter the gutter—but now more assured of doing so, and through the use of the longer and wider flaps 50, than was previously the case. Any water flow along the tabs 60, between the interrupted slots 40, creates no problem as such flow will continue along the tab 60, until it reaches the lower section 58 of the front surface 54—where, since everything is positioned below the lip 48, causes the water to drip internally of the trough 62.

As a result, any tendency for the slots 40 to clog with either needles and/or tree sap is reduced through the use of the larger-size slots 40 reducing any need to brush them clear. The downspout will remain unobstructed by any size leaves or debris which might enter through the slots 40—as described above—and the longer flaps 50 minimize any water flow that might otherwise drip down outside the gutter. By having the tabs 60 within the trough 62, the tendency for any flow to miss the slots 40 and fall outside the gutter is reduced as well.

As also shown, by virtue of the lower edge 46 of the slots 40 falling below the surface of the lip 48, any readily available clip—as by 64—can be employed to secure the cover 12 to the gutter 10, merely by extending over a top side 66 of the lip 48 and under an underside 68 of the lower section 58 of the front surface 54. An easy fastening can thus result, without the need for any tools, and can be accomplished in a simple manner by the average handyman or homeowner. One material which proved readily useful in constructing the cover of the invention was determined to be aluminum, or an aluminum alloy, which provided the resilient flexibility and strength required to be bent under the shingles of the roof, yet to withstand the forces of rain, wind and snow.

As far as construction of the cover of the invention is concerned, it will be understood that the top and bottom surfaces may be made from separate materials, and then suitably shaped and joined in any appropriate and available manner, or formed from a single piece of material, shaped in cross-section by any suitable manner known in the art. In such respects, the top and front surfaces of the invention can be merged into an outwardly rounded edge 70, to facilitate a smooth flow of rainwater from the top surface 42 onto the front surface 54, and from there, either by means of the flaps 50 or tabs 60 into the trough 62 of the gutter 10.

Figure 5:
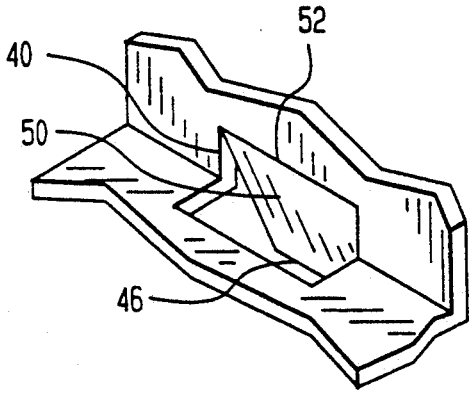
FIG. 5 is an enlarged partial view illustrating a slot and flap according to the invention.

In comparable manner, it will be appreciated that the flaps may be preferably formed integrally with the front surface 54 by stamping or die cutting the flaps 50 out of the front surface 54, and by bending the flaps 50 generally inwardly and downwardly to the positions required. The slots 40 will then be appreciated to be formed or provided in the spaces in the front surface 54 where the flaps 50 had been bent and pushed back inwardly (FIG. 5).

While there has been described what is considered to be a preferred embodiment of the present invention, it will be readily appreciated by those skilled in the art that modifications can be made without departing from the scope of the teachings herein. Thus, whereas the present invention has been described in the context of utilizing the cover of the invention for a hollow rain gutter which is secured so as to receive the rainwater coming off of the roof of the dwelling or building to which the gutter is secured; if such roof is shingled, then by having the resiliently flexible top surface 42 fabricated of aluminum or aluminum-alloy material, it becomes a simple matter to insert the top surface 42 under the front row of shingles on the roof. However, the invention will be seen to operate equally as well where the top surface 42 is made to just abut the dwelling or structure even where an air-tight join is not made with the facial board of the structure, especially where any space that exists is of insufficient size to permit any of the leaves, twigs or other debris from entering at that location. For at least such reason, therefore, resort should be had to the claims appended hereto for a true understanding of the scope of the invention.

I claim:

1. A cover of predetermined material for a hollow gutter of the type which is secured to the facial board of a structure and which incorporates a trough for receiving rainwater culminating in a defined front lip, comprising:

an upwardly pitched top surface extending rearwardly to reach said facial board;

a downwardly pitched front surface extending toward the front lip of said gutter, and composed of a pair of upper and lower angularly disposed sections; and a single row of spaced-apart, interrupted slots running horizontally along said front surface said slots having an upper and lower edges;

with the lower-edges of said slots extending in said lower section below the front lip of said gutter, and with a plurality of rearwardly and downwardly extending flaps provided along the upper edges of said slots for diverting rainwater into said hollow gutter;

whereby received rainwater flows down said top and front surfaces, and along said flaps, into said trough.

2. The cover of claim 1 for a hollow gutter of the type coupled to a downspout in use, and wherein said slots are of dimension to prevent to passage of leaves of a size otherwise able to clog said downspout in operation.

3. A cover of claim 2 wherein there are additionally included fastener means for connecting said lower section of said front surface to the lip of said gutter.

4. The cover of claim 3 wherein said means includes a plurality of clips extending over a top side of said lip and under an underside of said lower section in fastening said lip and lower section together.

5. The cover of claim 1 for a hollow gutter of the type which is secured to the facial board of a structure having a shingled roof, wherein said top surface is dimensioned to seat beneath at least a portion of the first row of shingles thereon.

6. The cover of claim 5 wherein said cover is of predetermined material, resiliently flexible for ease of positioning in seating said top surface beneath said shingles.

7. The cover of claim 6 for a hollow gutter of the type coupled to a downspout in use, and wherein said slots are of dimension to prevent the passage of leaves of a size otherwise able to clog said downspout in operation.

8. The cover of claim 7 wherein said interrupted slots are of the order of 1¼" in length, and 1¼" in width.

9. The cover of claim 8 wherein said flaps are of the order of 1" in length and 1" in width.

10. The cover of claim 9 wherein said cover is fabricated of an aluminum or aluminum-alloy material.

11. The cover of claim 7 wherein said flaps are formed integrally with said front surface by stamping or die-cutting said flaps out of said front surface, and by bending said flaps generally inwardly and downwardly, said slots being then formed in the spaces in said front surface where said flaps have been bent inwardly.

12. The cover of claim 11 wherein said top surface and said front surface merge into an outwardly rounded edge to facilitate a smooth flow of rainwater from said top surface onto said front surface.

* * * * *